United States Patent [19]

Sayre

[11] 4,096,609

[45] Jun. 27, 1978

[54] PROCESS FOR MAKING STRETCH FABRIC CAPABLE OF COURSE COUNT CONTROL UPON HEAT SETTING

[75] Inventor: James Franklin Sayre, Wilmington, Del.

[73] Assignee: E. I. Du Pont de Nemours and Company, Wilmington, Del.

[21] Appl. No.: 700,069

[22] Filed: Jun. 28, 1976

[51] Int. Cl.[2] ..... D04B 21/18

[52] U.S. Cl. ..... 28/155; 28/167; 28/170; 66/192; 66/195

[58] Field of Search ..... 66/192, 193, 195, 172 R; 28/155, 167, 170

[56] References Cited

U.S. PATENT DOCUMENTS

| | | | |
|---|---|---|---|
| 2,133,935 | 10/1938 | Johnson | 66/192 |
| 2,147,169 | 2/1939 | Mendel et al. | 66/195 |
| 2,518,407 | 8/1950 | Weinberg | 66/193 |
| 3,177,875 | 4/1965 | Garson | 128/540 |

FOREIGN PATENT DOCUMENTS

| | | | |
|---|---|---|---|
| 6,916,335 | 10/1970 | Netherlands | 66/195 |
| 860,929 | 2/1961 | United Kingdom | 66/192 |
| 910,615 | 11/1962 | United Kingdom | 66/195 |
| 1,033,144 | 6/1966 | United Kingdom | 66/172 R |

OTHER PUBLICATIONS

Neuhaus, Application Serial No. 677,989 filed Apr. 19, 1976, laid open to public inspection on Dec. 7, 1976 as noted at 849 O.G. 1221.

Research Disclosure No. 10205, Oct. 1972, *Stretchable Knit Fabric Containing Spandex Yarn,* S 3049 0035.

*Primary Examiner*—Robert R. Mackey

[57] ABSTRACT

Course count control during heat setting of stretchable warp knit fabric is provided by selvedge knitted with the fabric and along its edges, the selvedge having a predetermined lesser stretchability than that of the fabric to serve as a limit stop to the longitudinal stretch of the fabric to provide the course count desired for the fabric.

4 Claims, 4 Drawing Figures

PROCESS FOR MAKING STRETCH FABRIC CAPABLE OF COURSE COUNT CONTROL UPON HEAT SETTING

BACKGROUND OF THE INVENTION

This invention is related to longitudinally stretchable warp knit fabrics and more particularly to control of the stretchability of the fabric in order to uniformly achieve the desired course count.

In warp knitting a stretchable elastic yarn-containing fabric, the fabric is stretched approximately to the maximum during passage from the knitting needles of the knitting machine to the take-off mechanism thereof. After take off, the fabric is allowed to relax and in doing so, the fabric contracts until jamming of the stitches permits no further contraction of the elastic yarn of the fabric. The weight of the resultant fabric is too great for many end uses. For this reason, such weight has been reduced by stretching the fabric to a lower weight and then heat setting the fabric in a continuous in-line operation. The heat setting maintains the fabric in the stretched, lower weight state. The heat set fabric still has stretchability, however, up to the maximum stretch condition previously achieved between the knitting needles and take-off mechanism of the knitting machine.

Unfortunately, it has been a problem to get the fabric weight desired in the heat setting operation because of the difficulty in uniformly stretching the fabric in the longitudinal direction in a continuous in-line heat setting operation. Instead of being at the weight desired, the heat set fabric tends to vary in weight along the length of the fabric, leading to fabric lengths that are too heavy or too light for the intended use.

Fabric weight and weight uniformity can be expressed by the course count of the fabric, i.e., the number of courses per cm. The heavier the fabric weight, the greater the course count at constant fabric width. Course count uniformity means uniform weight along the length of the fabric.

SUMMARY OF THE INVENTION

The present invention solves the aforesaid problem arising in heat setting by providing a process for producing a knit fabric capable of being longitudinally stretched and heat set to a predetermined course count, comprising warp knitting elastic and inelastic yarn into a fabric which is longitudinally stretchable and simultaneously warp knitting selvedge along each edge of said fabric, said selvedge having a predetermined lesser stretchability than the longitudinal stretchability of said fabric to limit said lonitudinal stretchability during heat setting to the stretch which provides said predetermined course count. Not only does the process enable the heat setting operation to produce the predetermined course count or fabric weight desired, the course count is also more uniform along the length of the fabric. The predetermined lesser stretchability of the selvedge described herein refers to the selvedge having a limit of stretch which is less than the longitudinal stretchability of the fabric.

FIGS. *2a*, *2b*, and *2c* show one embodiment of warp knitted fabric and selvedge of the present invention in terms of knitting machine guide bar motions in a point diagram. FIG. *2a* shows the motion of the front guide bar supplying inelastic yarn to the fabric and selvedge, FIG. *2b* of the middle guide bar supplying elastic yarn to the fabric and selvedge, and FIG. *2c* of the back guide bar supplying additional inelastic yarn to the selvedge.

DETAILED DESCRIPTION OF THE INVENTION

Figure 1:
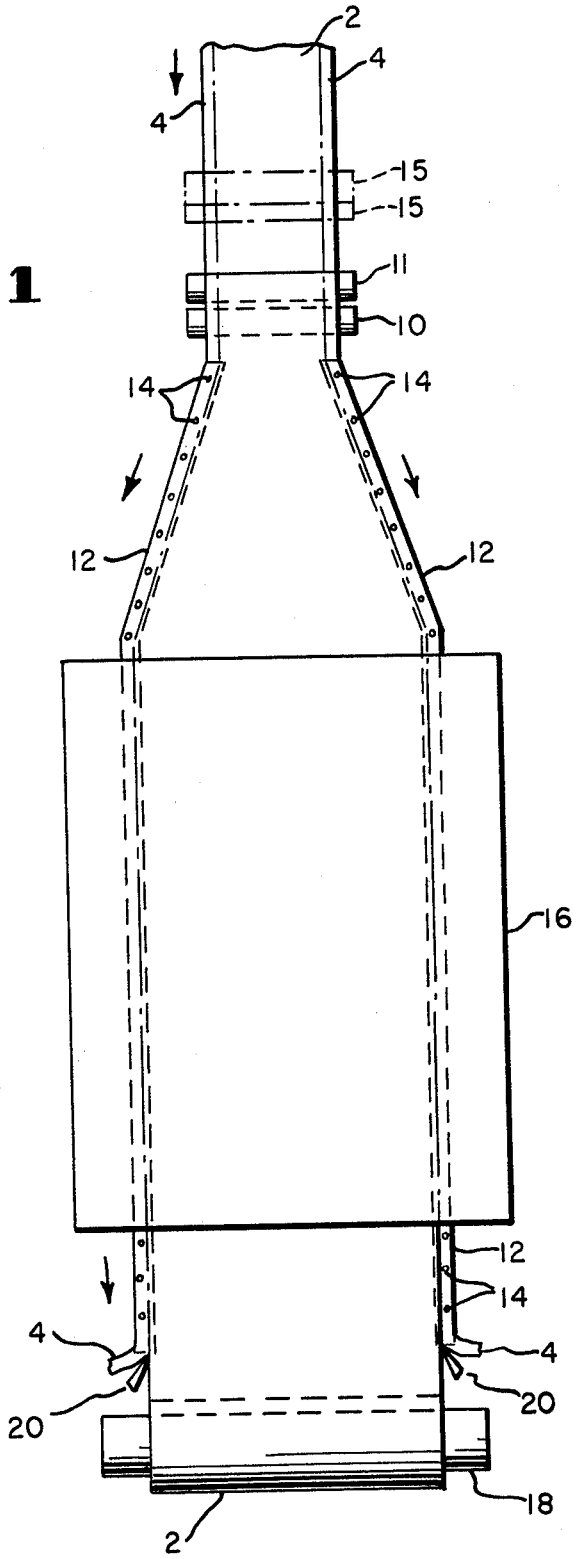
FIG. 1 shows schematically and in plan view the stretching and heat setting of fabric to a lesser course count.
Figures 2A, 2B, 2C:
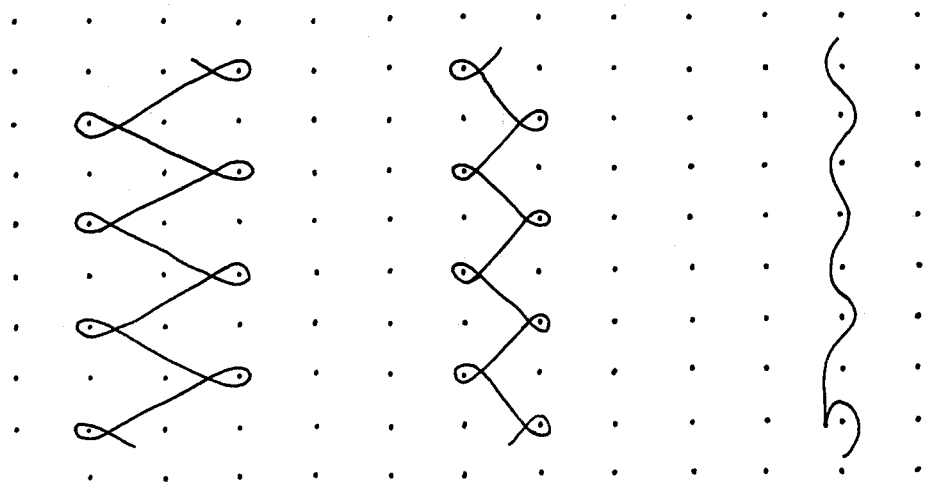

FIG. 1 shows a fabric 2 of the present invention having selvedge 4 integral with the fabric along each of its longitudinal edges being subjected to stretching and heat setting in the stretched state. The selvedge has a predetermined lesser stretchability than the longitudinal stretchability of the fabric to limit the longitudinal stretch of the fabric to the heat set course count desired for the fabric. The fabric 2 is moving in the direction indicated to be subjected to continuous in-line stretching and heat setting.

The fabric 2 is longitudinally stretched to the limit permitted by the selvedge 4 by rotating feed rolls 10 and 11 engaging the fabric in that order and operating at a slower surface speed than the speed of upstanding pins 14 mounted on endless chains 12 moving in the direction indicated. The longitudinal stretch of the fabric thus occurs between the feed rolls 10 and the first of the pins 14 engaging the fabric. The upstanding pins 14 engage the fabric by piercing the selvedge.

The endless chains 12 move in the diverging path shown in FIG. 1 to spread (laterally stretch) the longitudinally stretched fabric to the desired width. This spreading also reduces fabric weight and is accurately controllable by the fixed path of the pins 14 engaging the fabric.

Upon reaching the spread width desired, the longitudinally and laterally stretched fabric is passed through heat setting over 16 by continued movement of the endless chains 12 and pins 14 in the parallel path shown in the drawing. In the oven 16, the fabric is heated to a sufficient temperature to cause the fabric to remain in this stretched state. On emerging from the oven, the heat-set fabric is disengaged from pins 14 and wound up on roll 18.

The selvedge 4 can be trimmed from the fabric 2 by knives 20 prior to windup as shown in FIG. 1 or after windup. Upon trimming off of the selvedge from both edges, the fabric can be stretched further up to the maximum stretch in the particular end use such as underwear or outerwear desired.

The stretching and heat setting apparatus used is conventional. The feed rolls 10 or other feed mechanism used in tandem therewith or in place thereof are operated at a slower speed than the speed of the endless chains 12, with the speed differential being adjusted to produce the maximum stretch of the selvedge 4 of the fabric 2. For example, if a greater amount of longitudinal stretch of the fabric is desired than can be provided by the speed differential capability of the feed rolls 10 and 11 and pins 14, then a pair of rolls 15 shown in phantom lines in FIG. 1 (such as may be used in a padder) may be used to grip the fabric in the nip between the rolls and further slow down the feed rate of the fabric. This would lead to some stretching of the fabric in passing from the rolls 15 to the feed rolls 10 and 11. In any event, the total longitudinal stretch of the fabric upon reaching pins 14 corresponds to the limit of stretchability of the selvedge. The pins 14 and endless chains 12 are part of a conventional tenter frame.

Any warp knit stretch fabric of elastic and inelastic yarn that is normally subjected to heat setting to reduce fabric weight can be provided with selvedge in accordance with the principle of the present invention in order to obtain the course count and fabric weight uniformity desired in the heat setting operation. The fabric will be stretchable at least 10% in the longitudinal direction, preferably at least 25% and more preferably at least 75%. The elastic yarn imparts this stretchability to the fabric. Such yarn has at least 100% elongation before break, substantially complete recovery from stretch, and is heat settable to remain in the stretched condition desired. Preferred elastic yarn is segmented polyurethane generically known as spandex. The inelastic yarn is essentially non-stretchable except as may be provided by texturing of the yarn. Such yarn is any conventional textile yarn, either continuous filament or staple, and includes both textured and nontextured yarns. The wrap knitting of the elastic yarn into the fabric may include knitting or laying in the yarn into the fabric to give it its stretch character or such yarn may be incorporated into the fabric by a combination of knitting and laying in.

The selvedge has the predetermined lesser stretchability, i.e., longitudinal stretchability, than the longitudinal stretchability of the fabric as previously described herein. The effect of this lesser selvedge stretchability is that the selvedge is stretched to the maximum between the knitting needles and the takeup mechanism of the knitting machine. At this selevedge stretch condition, the fabric is longitudinally stretched to this extent only and not to its maximum stretchability as is the usual situation. This less than maximum extent of the stretch state is generally approximately the course count or fabric weight desired from the heat setting operation. In essence, the fabric/selvedge condition of stretch between knitting needles and take-up mechanism of the knitting machine is substantially reproduced in the longitudinal stretch of the fabric done for heat setting.

Any difference between selvedge course count and heat set fabric course count, that might arise by virtue of slightly different longitudinal stretch conditions in the knitting operation as compared to the heat setting operation, the effect of the heat in the heat setting operation of the fabric, and/or the possibility of heat setting efficiency not being 100%, can be compensated for by adjustment of the selvedge course count during knitting. If the heat set fabric course count is greater than desired for given heat setting conditions, then the selvedge course count can be decreased in the knitting operation by a corresponding amount to obtain the heat set course count desired. Further adjustment of selvedge course may be made, i.e., of the nature of "fine tuning" if necessary. Thus, the selvedge course count is predetermined to give the heat set fabric course count desired from a given set of in-line stretch and heat setting conditions.

The width of the selvedge can be varied as desired provided it has sufficient strength to withstand the stretching during knitting and heat setting and sufficient width for engagement by the pins 14 in the tentering step of the heat setting operation. Generally, the selvedge along each fabric edge will be from 1 to 6 cm wide.

Various methods are available for making the selvedge which have a predetermined lesser stretch than the longitudinal stretchability of the fabric. In one embodiment, an additional inelastic yarn is incorporated into the selvedge at a runner length (for the particular stitch used to incorporate such yarn into the selvedge) which gives the selvedge its predetermined lesser stretchability. This embodiment can be practiced by setting up the knitting machine to knit the fabric having the quality (at maximum stretch between knitting needles and take-up mechanism) desired. Runner lengths of the elastic and inelastic yarns are adjusted for good knitting. The take-up speed of the knitting machine is then decreased to produce a knit quality approximately corresponding to the course count of the fabric desired from the heat-setting operation. Runner length of the additional inelastic yarn fed only to the selvedge of the fabric is shortened to a suitable tension for knitting at this increased course count, but the runner length of the inelastic yarn of the fabric is not changed. Thus, this particular inelastic yarn will be "overfed" during the knitting operation. The runner length of the elastic yarn can be shortened to provide the correct tension for knitting at the increased course count. This reduces the amount of elastic yarn in the fabric, thereby making it a more economical fabric. Knitting of the desired fabric can then begin to produce the fabric of this invention. The selvedge is integral with the fabric in the sense that both are knitted at the same time and together.

In this embodiment, the stitch pattern and yarns of the fabric are also present in the selvedge. The stretchability of the selvedge that might be expected of the selvedge because of the presence of elastic yarn therein is limited by the additional inelastic yarn of relatively short runner length incorporated into the selvedge. The course count of the selvedge can be adjusted to the predetermined course count desired by adjusting the runner length of the additional inelastic yarn for the particular stitch pattern (including lay-in) used to incorporate this yarn into the selvedge.

The additional inelastic yarn is preferably incorporated in the selvedge in as nearly a straight line as possible. This is accomplished by laying-in of the yarn. However, for retention in the selvedge, the selvedge yarns should form an occasional stitch, the frequency of which can vary as desired. Thus, it is preferred to lay-in the selvedge yarns for a few courses for best control of selvedge extensibility and then knit occasionally, e.g., at least once every sixteenth course. The additional inelastic yarn is preferably nontextured. No edge curl occurs in the knitting of the fabric.

The following examples illustrate this embodiment:

EXAMPLE 1

On a three guide-bar, 32-gauge, Mayer tricot knitting machine (84 inch fabric width), the front guide bar is fully threaded with 40 total denier, 13-filament, interlaced, continuous filament nylon yarn as the inelastic yarn, and the middle guide bar is fully threaded with 40-denier, coalesced multifilament spandex yarn as the elastic yarn. The terminal 64 guides at each end of the back guide bar are the only guides of this bar threaded with yarn and the yarn used is the same nylon yarn (as the additional inelastic yarn) as used in the front bar, but the back guide bar yarns are drawn from two separate, narrow beams. The front bar stitch pattern is 2-3/1-0 and repeat, as shown in FIG. *2a*, the middle bar stitch pattern is 1-0/1-2 and repeat as shown in FIG. *2b*, and the back bar stitch pattern is 0-1/1-1/0-0/1-1/0-0/1-1/0-0/1-1, as shown in FIG. *2c*.

The take-up mechanism of the knitting machine is adjusted for knitting fabric quality of 60 courses/inch (23.6/cm) at maximum stretch. The yarn beam letoffs are then adjusted for proper knitting, and the front bar runner length is found to be 58 inches (147.3 cm) per rack (480 courses). The take-up gears are then adjusted to the predetermined quality of 71 courses/inch (28/cm). The front guide bar runner length is not changed, but the back guide bar runner length is adjusted for proper knitting at this predetermined knitting quality and is found to be 7½ inches (19 cm) per rack. The middle guide bar runner length is decreased to 26.4 inches (66 cm) per rack (from a beam of spandex yarn wound at 65% elongation) which affords a tension of approximately 4 grams per end of spandex yarn as fed to the knitting elements. Upon removal of the fabric from the take-up mechanism, the fabric retracts from the as-knit course count of 71 courses/inch to a course count of 115 courses/inch (45.3/cm).

The resultant fabric is stretched lengthwise to the limit of stretchability of the selvedge and is fed to the pins to a tenter frame which diverge to a width of 62 inches (157.5 cm) where the fabric is heat-set for 20 seconds at 385° F (196° C). The lengthwise stretching of the fabric is done by feeding the fabric to the feed rolls of the tenter frame from a roller equipped with a friction let-off, whereby the fabric is stretched in passing from the roller to the feed rollers and further to the aforesaid limit in passing from the feed rollers to the pins of the tenter frame. The resultant fabric is scoured and dried to yield and elastic fabric containing 48 wales per inch (18.9/cm) and the desired quality of 75 courses per inch (29.5/cm) uniformly along the fabric length, and after trimming away of the selvedge, having 58.8% and 57.5% stretch in the lengthwise and lateral directions, respectively. These elongations are measured on fabric samples 7.62 cm wide and 7.62 cm gauge length using a 1.362 kg load at an elongation rate of 15.24 cm/min.

EXAMPLE 2

The three-bar knitting machine described in Example 1 is threaded with the yarns as in that Example. The front guide bar stitch pattern is 2-3/2-1/1-0/1-2, the middle guide bar stitch pattern is 1-0/1-2/2-3/2-1, and the back bar stitch pattern is 1-0/0-0/1-1/0-0. The take-up gears of the machine are adjusted for knitting fabric quality of 60 courses/inch (23.6/cm). The yarn beam let-offs are adjusted for proper knitting and the front bar runner length is found to be 49 inches (124.5 cm) per rack. The take-up mechanism is then adjusted for a course count of 101 courses/inch (39.8/cm). The front guide bar runner length is not changed, but the back guide bar runner length supplying the inelastic yarn to the selvedge is adjusted for proper knitting at this changed (predetermined) knit quality and found to be 5½ inches (14 cm) per rack. The middle bar runner length is shortened to 22.8 inches (57.9 cm) per rack to afford a tension of approximately 4 grams per end of spandex yarn as fed to the knitting elements. Upon retraction, the course count of the fabric changes from 101 courses/inch to 152 courses/inch (59.8/cm).

The resultant fabric is scoured, dried, and stretched lengthwise as in Example 1 to the limit of stretchability of the selvedge and is fed to the pins of a tenter frame diverging to a width of 53 inches (134.6 cm), where the fabric is heat-set for 20 seconds at 385° F (196° C). The resultant elastic fabric has 59.4% stretch in the lengthwise direction and contains 56 wales per inch (22/cm) and the desired uniform course count of 95 courses per inch (37.4/cm).

As one skilled in the art will recognize, other stitch patterns can be used in this embodiment and in the embodiment to be discussed next to incorporate the additional inelastic yarn into the selvedge to provide its predetermined course count.

In another embodiment, the selvedge is essentially nonstretchable in that the elastic yarn is omitted from the selvedge while being retained in the fabric to impart stretchability to it. In this embodiment, too, an additional inelastic yarn is incorporated into the selvedge along with the inelastic yarn of the fabric. This embodiment is illustrated by the following example:

EXAMPLE 3

The yarns used in this Example are the same as in Example 1. The inelastic yarn is fed from the front guide bar and the spandex yarn from the back guide bar of a two guide-bar knitting machine. Alternate needles are removed from the terminal 5.08 cm at each end of the needle bar of the knitting machine. The remaining needles at the terminal ends of the machine are spaced 0.159 cm apart. Appropriate alternate yarns are removed from the corresponding portions of the front guide bar of the knitting machine. The alternately removed yarns are threaded in the adjacent guide in the front guide bar so that two ends per guide are knit. The knitting motion of the front guide bar is 1-0/2-3. Additional inelastic yarns are fed from separate short spools, one end per guide at the terminal 5.08 cm at each end of the back guide bar and the spandex yarn is omitted from these guides. In this arrangement, the knitting motion of the back guide bar is 1-2/1-0. The effect of the missing needles is to produce selvedge of two chain-like structures knit from adjacent back guide bar yarns on each needle. One of these adjacent yarns knit on alternate courses (i.e., 1-0/1-1) and the other of these adjacent yarns knit on intervening courses (i.e., 0-0/0-1).

From this threading and knitting arrangement, yarns are knit into the selvedge at every course. The extensibility of the selvedge is limited to that which results from deformation of the stitch pattern of the selvedge. In this Example, the original quality to which the knitting machine is adjusted is 60 courses/inch (23.6/cm) requiring a runner length of 58 inches (147.3/cm) for the inelastic yarn. The knit quality is then changed to the predetermined course count of 107 courses/inch (42.1/cm) by changing to appropriate take-up gears and by shortening the runner length of the additional inelastic yarn fed from the back guide bar to 18 inches (45.7/cm). Other runner lengths were not changed. The resultant fabric had a course count of 132 courses/inch (52.0/cm). The fabric was stretched and heat set as in Example 2 to the desired uniform course count of 78 courses/inch (30.5/cm).

As many apparently widely different embodiments of this invention may be made without departing from the spirit and scope thereof, it is to be understood that this invention is not limited to the specific embodiments thereof except as defined in the appended claims.

What I claim is:

1. A process for producing a knit fabric capable of being longitudinally stretched and heat set to a predetermined course count, comprising warp knitting a longitudinally stretchable fabric of elastic and inelastic yarn and simultaneously warp knitting an additional inelastic yarn into the selvedge along each edge of said fabric, said first-mentioned inelastic yarn being overfed with respect to said additional inelastic yarn during said warp knitting, said additional inelastic yarn imparting a predetermined limit of stretchability to said selvedge which is less than the longitudinal stretchability of said fabric to limit said longitudinal stretchability during heat setting to the stretch which provides said predetermined course count, subjecting said fabric to stretching to the limit provided by said selvedge, and heat setting and fabric.

2. The process of claim 1 and additionally trimming said selvedge from said fabric after said heat setting.

3. The process of claim 1 wherein said selvedge includes said elastic yarn and is stretchable.

4. The process of claim 1 wherein said selvedge is free of said elastic yarn and is substantially non-stretchable.

* * * * *

UNITED STATES PATENT OFFICE

CERTIFICATE OF CORRECTION

PATENT NO. : 4,096,609

DATED : June 27, 1978

INVENTOR(S) : James Franklin Sayre

It is certified that error appears in the above-identified patent and that said Letters Patent are hereby corrected as shown below:

| Patent Column | Patent Line | |
|---|---|---|
| 1 | 52 | "lonitudinal" should read --longitudinal-- |
| 2 | 39 | "over" should read --oven-- |
| 3 | 21 | "wrap" should read --warp-- |
| 5 | 22 | "pins to" should read --pins of-- |
| 5 | 31 | "and elastic" should read --an elastic-- |
| 8 | 2 | "and" should read --said-- |

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*